US005622335A

United States Patent [19]

Trouillot et al.

[11] Patent Number: 5,622,335

[45] Date of Patent: Apr. 22, 1997

[54] TAIL PIECE FOR A PROJECTILE HAVING FINS EACH INCLUDING A RECESS

[75] Inventors: Christian Trouillot, Sainte Thorette; Yves Millet, Fussy; François Beauvais, Bourges, all of France

[73] Assignee: Giat Industries, Versailles, France

[21] Appl. No.: 493,968

[22] Filed: Jun. 23, 1995

[30] Foreign Application Priority Data

Jun. 28, 1994 [FR] France ..... 94 07952

[51] Int. Cl.[6] ..... F42B 10/06

[52] U.S. Cl. ..... 244/3.24; 102/385; 102/517; 102/521; 244/3.1

[58] Field of Search ..... 244/3.1, 3.23, 244/3.24–3.3; 102/517, 521, 385, 372–374

[56] References Cited

U.S. PATENT DOCUMENTS 3,392,934 7/1968 Daniels ..... 244/3.23

4,004,514 1/1977 Daniels ..... 244/3.29

FOREIGN PATENT DOCUMENTS 0078921 5/1983 European Pat. Off. .
0174082 3/1986 European Pat. Off. .
1003652 3/1952 France .
1064569 5/1954 France .
2507765 12/1982 France .
2599828 12/1987 France .
2606869 5/1988 France .
3927918 2/1991 Germany .

OTHER PUBLICATIONS

Abstract of EP 0 300 373, Jan. 1989.

*Primary Examiner*—Harold J. Tudor
*Attorney, Agent, or Firm*—Oliff & Berridge

[57] ABSTRACT

A tail piece for a projectile includes at least three fins connected to either the projectile itself or a bracket connected to the projectile. Each fin is linked to the projectile/bracket by at least one fastening foot that cooperates with at least one recess of the projectile/bracket.

22 Claims, 3 Drawing Sheets

TAIL PIECE FOR A PROJECTILE HAVING FINS EACH INCLUDING A RECESS

BACKGROUND OF THE INVENTION

The subject of the present invention is that of a tail piece for a projectile or sub-projectile, for example a supersonic sub-caliber projectile.

The function of a tail piece is to ensure the aerodynamic stabilization of a projectile in its trajectory.

Tail pieces are commonly used to stabilize projectiles fired by smooth barrelled or rifled guns of large or medium caliber, or by light, recoilless launchers.

This mode of stabilization is the only one that may be used for projectiles fired by a smooth barrelled gun.

Furthermore tail pieces enable projectiles to be stabilized that have a high length to diameter ratio (greater than 7). In fact, however projectiles can not be gyroscopically stabilized.

These projectiles, usually called fin-stabilized projectiles. comprise a sub-projectile or penetrator placed in a sabot (to the calibre of the barrel) which frees the penetrator upon exit from the barrel. See, for example, patent FR2507765, which describes a large caliber (greater than 75 mm) fin-stabilized projectile fitted with a stabilizing tail piece.

The tail piece ensures the stable flight of the penetrator over very great distances (over 2 km for projectiles fired by 120 mm tank cannons).

Such projectiles stabilized by a tail piece nevertheless spin at a moderate speed (around 80 revs/second for a large caliber projectile). a movement that makes up for the geometric dissymmetries of the projectile and that ensures firing accuracy.

This spin is more often than not obtained by deflecting the fins, or by curvature, or else by suitable machining of the leading and trailing edges of the tail piece fins.

In the event that a fin-stabilized projectile must be fired from a rifled barrel, it must be fitted with a sliding drive band that avoids the projectile from being driven at full spin by the rifling of the barrel.

In fact, an excessive spin rate, for a fin-stabilized projectile, causes its immediate destabilization because of the Magnus strain to which it is subjected on its trajectory.

Patent FR2606869 thus describes a sliding drive band that may be used for a large caliber fin-stabilized projectile.

Despite all the studies that have been conducted up to date, the stabilization of fin-stabilized projectiles still causes problems.

It must thus be noted that, during firing, the projectile always has a certain obliquity with respect to the aerodynamic flow. It is not uncommon for an obliquity to be within the range around 2° to 3°, which is caused by the disturbances to which the projectile was subjected in the gun barrel and upon exit form the gun barrel.

In the case of sub-caliber projectiles, the separation of the sabot/penetrator also cause a slight obliquity of the penetrator.

The combination of the spin rate and the obliquity generates a Magnus force on the tail piece of the projectile, a force that is exerted in the normal plane to the plane of resistance, i.e., the plane defined by the longitudinal axis of the projectile and its velocity vector.

This strain generates a torque that downgrades performances in external ballistics and may completely destabilize the projectile. The drop in performance is characterised by an increase in loss of velocity, lower accuracy and a reduction in terminal effectiveness, which may be significant.

The harmful effect of the Magnus force is even more significant when the obliquity and spin rate are high.

The influence of the obliquity is reinforced in the case of long projectiles (for example, supersonic sub-caliber projectiles). The interference drag of the wake (or boundary layer) with the tail piece is in fact greater in this case.

Nevertheless, in order to improve piercing performances, large caliber projectiles are now being manufactured that are as long as possible (a length greater than 30 times the diameter of the projectile).

The Magnus phenomenon is also preponderant when the spin rate of the projectile is high, which is the case of medium caliber projectiles (less than 75 mm), even when using a sliding drive band.

SUMMARY OF THE INVENTION

One aim of the invention is to make up for such disadvantages by providing a tail piece that enables the Mangus strains, which are exerted on the projectile during firing, to be reduced or even eliminated altogether.

A further aim of the invention is to provide a tail piece that is easy and inexpensive to manufacture and which enables piercing performances to be increased.

The subject of the invention is thus a tail piece for a projectile or sub-projectile, notably a supersonic sub-caliber projectile, comprising at least three fins implanted in a bracket, the tail piece being characterized in that each fin is connected to the bracket by at least one fastening foot and comprises at least one recess demarcated on one side by the outer surface of the bracket.

An advantage of such an arrangement is in that it enables large caliber discarding-sabot projectiles to be designed wherein the length is great with respect to the diameter (greater than 30 times the diameter), but which maintains a stable flight independent of the spin rate.

A further advantage of this arrangement is in that it allows projectiles (of large or medium caliber) to be fired from a rifled barrel at full spin rate without having to use a sliding drive band.

The elimination of the sliding drive band allows the projectile to be manufactured at a lesser cost and ensures the repeatability of firing parameters.

A further advantage of the invention is in that the tail piece is made lighter (which improves stabilization), and in that the tail piece exert any substantial shocks on the projectiles during impacts on targets having a great incidence or during their passage through multi-layer armor.

In fact the fastening feet may break easily, causing little disturbance to the projectile. The piercing performance is thus improved.

Advantageously, to improve the mechanical strength of the fin and to reduce vibrations, each fin may be connected to the bracket by at least two separate fastening feet separated the at least one recess.

According to an alternative, each fin may comprise a second recess extending between a rear fastening foot and the trailing edge of each tin.

According to yet another characteristic of the invention, each recess extends radially to a height that is determined so as to reduce the Magnus strain that is generated by an aeordynamic flow appearing on the body of the projectile when the projectile is in its trajectory at a certain obliquity.

The height (maximum or minimum) of each recess could, for example, by chosen to be greater or equal to the thickness of a boundary layer measured on the tail piece during firing and in operational conditions of maximum obliquity.

The height (maximum or minimum) of each recess could also be chosen such that it corresponds to between 40% and 80% of the thickness of a boundary layer such as may be measured on the tail piece during firing and in operational conditions of maximum obliquity.

According to a particular embodiment, the projectile maybe a fin-stabilized projectile, and the height of each recess lies between 10% and 50% of the half caliber of the tail piece.

According to practical alternative embodiments, each fastening foot of each fin is accommodated in a cavity arranged on the bracket, and the foot is fastened to the bracket by linking structure, for example, by welding or bonding.

The bracket may be fastened to rear part of the projectile body, for example, by threading.

The fin brackets may also be formed of the body of the projectile itself upon which cavities have been fitted.

BRIEF DESCRIPTION OF THE DRAWINGS

Other advantages will become apparent from reading the following description of the particular embodiments of the invention, a description made in reference to the appended drawings, wherein:

FIG. 3 being a cross-section of FIG. 2 along section III—III.

DETAILED DESCRIPTION OF PREFERRED EMBODIMENTS

Figure 1:
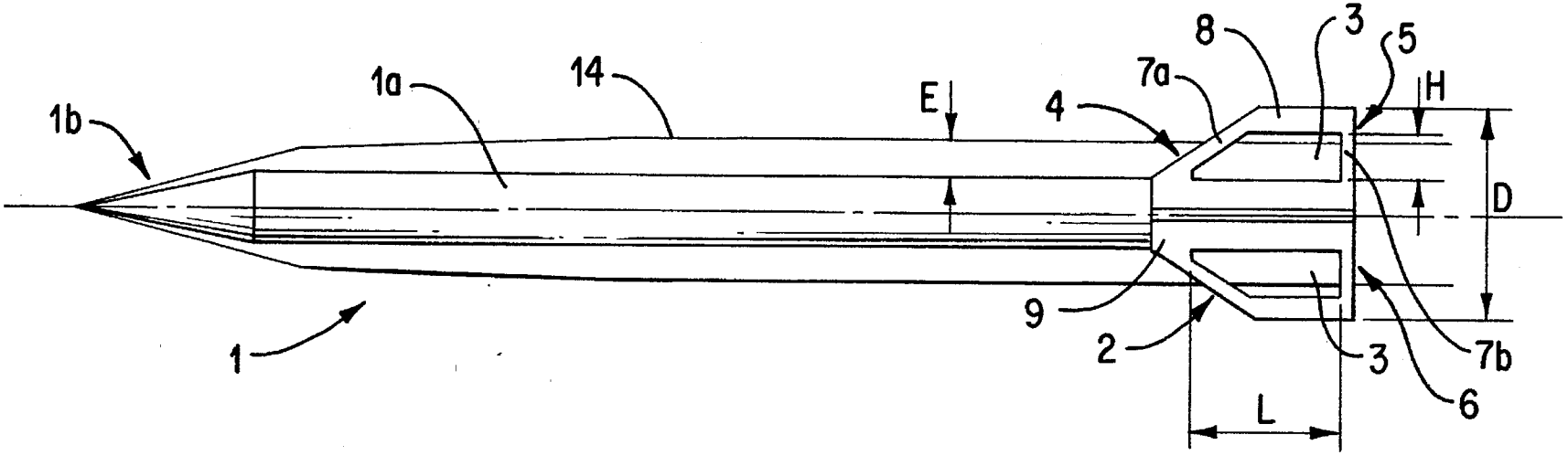
FIG. 1 shows a projectile fitted with tail piece according to the invention.

With reference to FIG. 1, a discarding sabot projectile 1 is shown on its trajectory. This projectile is a sub-caliber projectile that has been fired by a weapon (not shown) and has been released upon exit from the weapon by a sabot of a known type (not shown).

Reference will, for example, be made to patent FR2507765 that describes the usual structure of sub-caliber fin-stabilized projectiles as well as the sabot/projectile separating mechanism.

The projectile 1 carries on its rear part a tail piece 2 which in this example comprises four fins, evenly distributed at an angle. intergral with a bracket 9 (which may be the body of the projectile itself 1*a* or a part fastened to the body of the projectile).

The projectile 1 moves at a certain longitudinal velocity, it is therefore surrounded by what experts in fluids mechanics term a wake or a "boundary layer" (demarcated by line marked 14)

It also rotates at a certain rate around its longitudinal axis.

The boundary layer is formed by molecules of the fluid that has been passed through (air). The fluid is dragged by viscosity by the outer surface of the projectile during its flight thereby constituting an "envelope" in which there is a velocity gradient. The molecules that are closer to the outer surface of the projectile move roughly at the same velocity as the projectile as they are dragged by the projectiles and the molecules that are further away from the projectile have a lower velocity.

Conventionally, the thickness of the boundary layer corresponds to the thickness of the fluid in which the velocity of the adiabatic flow (i.e. the area beyond which the viscous effect no longer makes itself felt) may be matched to within 1%.

The boundary layer that is created by the velocity of the projectile is all the thicker when the projectile is a long one. It is logically thicker at the tail piece 2, than at the tip 1*b* of the projectile.

Lastly, the boundary layer has a turbulence rate due to the irregularities of the outer surface of the projectile.

When the axis of the projectile has a certain angle of obliquity with respect to its velocity vector, the joint presence of a spin rate of the projectile and an obliquity cause a force to appear, the so-called Magnus force.

This force is exerted on the tail piece and it is located in the normal plane to the plane of resistance (a plane defined by the longitudinal axis of the projectile and its velocity vector).

Several causes are attributed to the Magnus force, notably:

- the presence of dissymmetries in the boundary layer on the body of the projectile,
- interference drag of the body and tail piece,
- inequality of fin base pressure for fins diametrically opposite one another,
- deflection of the fins.

To reduce the Magnus force, the invention proposes to arrange at least one recess 3 on each fin, a recess demarcated on one side by the outer surface (in this example a cylindrical surface) of the brackets 9 upon which the fins are fastened.

Such an arrangement enables the interference drag between the boundary layer and the tail piece to be lessened, thereby enabling the Magnus force to be considerably reduced without incidentally prejudicing the stabilization effect produced by the supporting surfaces 8 of the fins.

In FIG. 1, each recess 3 has a generally rectangular shape and they extends longitudinally from a leading edge 4 of the fin to a rear part 5 of the tail piece, in this example, almost to the trailing edge 6.

The supporting surfaces 8 of each fin are therefore attached to the bracket 9, and thus to the body 1*a* of the projectile, by the two fastening feet, a front foot 7*a* and a rear foot 7*b*.

A length L will be chosen for the recess 3 that is the longest possible consistent with the mechanical strength of the fastening feet 7*a* and 7*b*.

The height H of each recess 3 will be chosen so as to minimize the Magnus strain that is generated by the aerodynamic flow when the projectile is at its maximum obliquity.

Such choices are made by the expert by means of wind tunnel tests and/or firing tests for the projectile in question.

A height H, for example, may be chosen for each recess which is greater or equal to the thickness E of the boundary layer as may be measured at the tail piece during firing and in operational conditions of maximum obliquity (thickness determined by wind tunnel tests or visualization on trajectory, for example, by shadowgraph).

In certain cases (very long projectiles), the wake (area of flow disturbed by the projectile) completely masks the tail piece, the decision may be made to minimize the Magnus force by taking a height H for each recess such that its value lies between 40% and 80% of the thickness of the boundary layer measured at the tail piece during firing and in conditions of maximum obliquity (thickness there is determined by means of wind tunnel or firing tests).

Different tests have been carried out that enable the effectiveness of the tail piece according to the invention to be demonstrated.

1st EXAMPLE

A 120 mm discarding-sabot munition was fired, wherein the projectile has a diameter of 25 mm and a length of 750 mm. It was fired with an initial velocity of around 1750 m/s, the spin rate being around 100 revs/second.

The tail piece of this projectile has a maximum diameter D of 100 mm, and each fin has a recess of a height H of 9 mm.

With such a tail piece, a Magnus moment coefficient substantially equal to zero can be measured.

However, a projectile in all ways identical but having a tail piece with no recesses has a Magnus moment coefficient of −10 to −20 reediness$^{-2}$.

The addition of recesses according to the invention causes a slight loss of static stability (reduction of the static margin of around 10%), but this loss is negligible. The new static margin (of around 6 calibers) still provides a hyperstable character to the projectile.

It may thus be seen that, thanks to the invention, the Magnus strain has completely disappeared. The invention therefore allows longer penetrators to be designed that remain stable and are made independent from the obliquity and the spin rate.

2nd EXAMPLE

A 45 mm caliber discarding-sabot munition was fired wherein the projectile has a diameter of 12 mm and a length of 240 mm. It was fired with an initial velocity of around 1600 m/s, the spin rate being around 400 revs/second.

The tail piece of this projectile has a maximum diameter D of 40 mm, and each fin has a recess of a height H of 4 mm.

As in the previous example, this tail piece enables a Magnus moment coefficient substantially equal to zero to be measured, whereas a projectile in all ways identical but having a tail piece with no recesses has a Magnus moment coefficient of −10 to −20 reediness$^{-2}$.

As may be seen from this example, the invention enables the stability of the projectile to be ensured even for high spin rates.

The invention thus allows medium caliber discarding-sabot munitions to be designed that are able to be fired at full spin rate (around 1300 revs/second for a 45 mm munition).

It is thus possible to fire a projectile fitted with the above-described tail piece at full spin rate. The fastening feet will be dimensioned in this event to withstand firing strains.

A further advantage of the invention is that the reduction of the Magnus moment coefficient also leads to a reduction in the static margin (stability). The reduction in stability remains low enough to avoid causing destabilization, but this results in an increase in the absorption of the oscillations of the projectile, which in turn leads to a quicker return to an obliquity nearer to zero thereby improving accuracy and terminal effectiveness.

By way of practical criteria in making this choice, in the event that the projectile is a fin-stabilized projectile (of whatever caliber), a height for each recess may be chosen that lies between 10% and 50% of the half caliber of the tail piece (or the maximum height of the fin).

This sample criteria of choice does not necessarily lead to a tail piece for which the Magnus strain is minimal for a given projectile configuration, but it leads to a tail piece for which this strain is significantly reduced with respect to that encountered where there are no recesses. Moreover, the advantages obtained enables the criteria of dynamic stability to be met.

Figure 3:
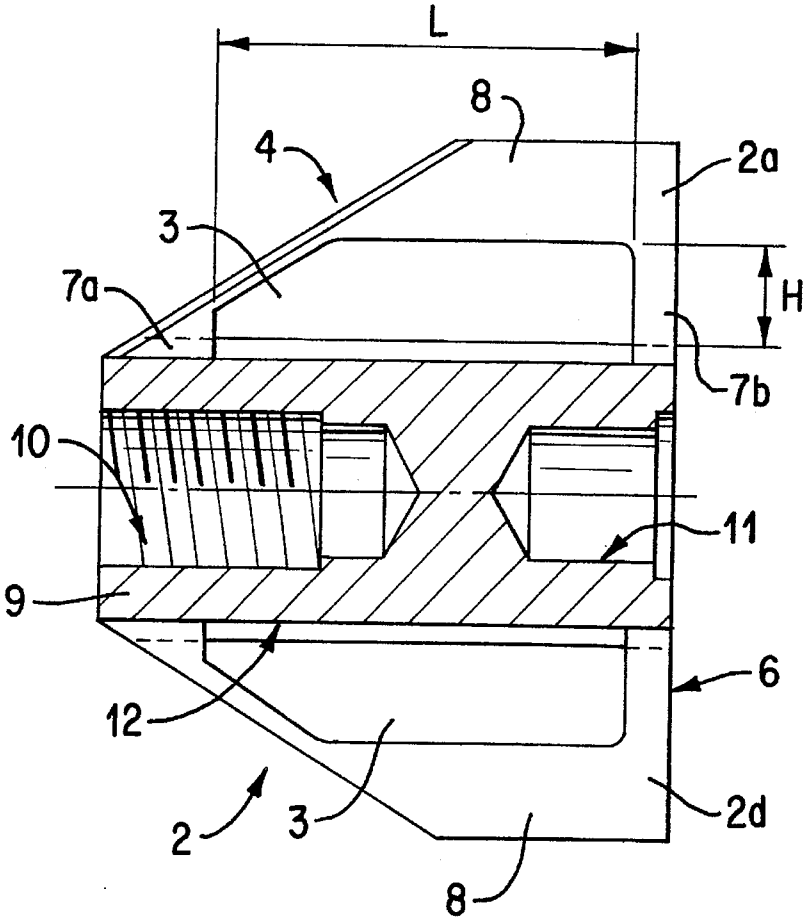
FIG. 2 and 3 show the tail piece according to a first embodiment of the invention.
Figure 2:
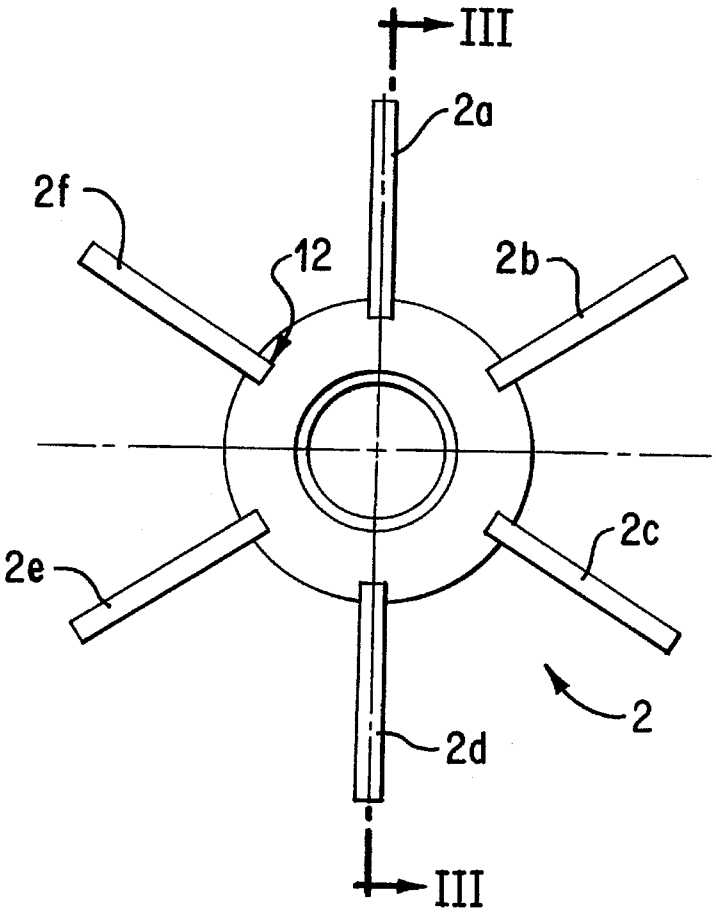

FIGS. 2 and 3 show a tail piece according to a first embodiment of the invention on a larger scale.

This tail piece comprises six fins 2*a*, 2*b*, 2*c*, 2*d*, 2*e* and 2*f* which are fastened to a roughly cylindrical bracket 9.

In a conventional manner, each fin has a bevelled leading edge 4 enabling a spin to be imparted to the projectile during firing from a smooth barrel.

The bracket 9 is made of aluminium alloy, it has a tapping 10 enabling it to be fastened to the body 1*a* of the projectile. A rear cylindrical housing 11 is designed to accommodate a flare.

The bracket 9 has six cavities around its periphery which take the shape of longitudinal grooves 12 evenly distributed at an angle.

The fastening feet 7*a* and 7*b* of each fin are accommodated in thes grooves and are fastened to the bracket 9 by a linking means, for example, by welding, bonding or brazing.

Manufacturing the tail piece is made much simpler. First of all the fins have to be manufactured, fitted with their recesses, by stamping in sheet steel, laser cutting or water jet cutting.

The fins may also be made of aluminium coated with a thermal protective coating.

Then the fins are positioned on the bracket 9 and are welded in place. The bracket 9 is rotationally symmetric and is inexpensive to produce.

Production costs are reduced with respect to conventional manufacturing by machining from a block the entire tail piece.

Figure 4:
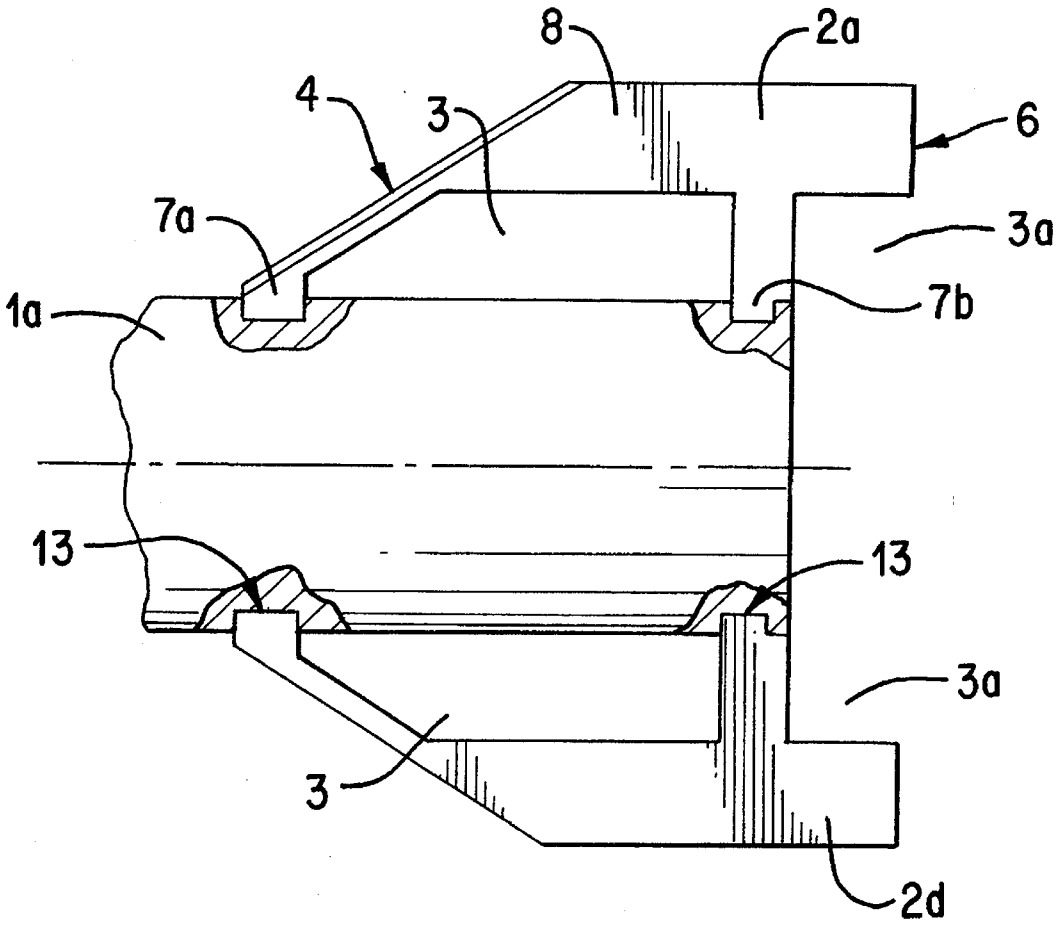
FIG. 4 shows the tail piece according to the invention according to a second embodiment of the invention.

FIG. 4 shows a second embodiment of the invention in which each fin 2*a*, 2*b*, 2*c*, 2*d*, 2*e* and 2*f* is directly fastened to the body 1*a* of the projectile, which thus acts as the cylindrical brackets 9 described above.

Cavities in the shape of longitudinal grooves may be made on the body 1*a* (as in the previous embodiment), or cavities may be made in the shape of cylindrical channels 13 (as shown in this example).

In this event, a suitable tool will be used to enable the angular positioning of the different fins with respect to the body 1*b* of the projectile before their fastening by welding or brazing.

This embodiment also differs from the previous one in that each fin has a second recess 3*a* that extends between the rear fastening foot 7*b* and the trailing edge 6.

In fact, such a tail piece is prolonged to the rear of the projectile to improve (if required for a given projectile) the static margin (thus the stability) of the projectile (distance between the center of gravity and the application point of the resultant of the aerodynamic forces).

In accordance with the invention, the second recess 3*a* enables the Magnus strain due to the interference drag between the boundary layer and the tail piece at the rear of the tail piece to be reduced.

It would be possible to give each recess a different height so as to take into account the particularities of the aerodynamic flow for the projectile in question.

In all the embodiments described, it is notable that the link between the fins and the projectile is ensured by the fastening feet 7*a* and 7*b* alone.

The fastening feet are designed to ensure the mechanical strength of the tail piece during firing and in the trajectory, when upon impact on a target, their reduced resistance section facilitates the separation of the fins from the body of the projectile.

Radial shocks on the body of the projectile, which often occur with known tail pieces, are thereby avoided during impact on targets having a great incidence. These shocks may cause the body of the projectile to rupture thus diminishing its piercing capacity.

By reducing the tail piece/projectile shocks during impact on a target, the invention therefore also adds to the terminal effectiveness of the projectile to which it is applied.

The invention is naturally likely to be subject to alternative embodiments, thus the recess may be of a different shape, for example with a variable height, the essential thing being that it is demarcated on one side by the outer surface of the bracket upon which the fin is fastened.

A recess may, for example, be provided wherein the height increases from the front to the rear of fin. The profile of the recess will be chosen so as to reduce the Magnus force. It would, for example, be possible to take the criteria of choice defined above applying them to the value H of the maximum height or to that of the mean height of the recess.

So as to improve the mechanical strength of the fins on their brackets, it is possible to provide several fastening feet each separated from the other by recesses.

In FIG. 3, a third fastening foot may, for example, be provided, positioned roughly half-way between the feet 7*a* and 7*b*, the three feet demarcating, in that case, two recesses on each fin.

It is also possible to provide a single fastening foot, preferably arranged on a leading edge of the fin, and a single recess extending longitudinally from this foot to the trailing edge.

In the previous examples the outer surface of the bracket has been shown with a cylindrical profile, but it could have a different profile, for example comprising one or several tapered areas, this in order to reduce base drag and to fulfil certain requirements of the projectile in question (aerodynamic stability, payload placed on the rear part such as a flare or incendiary device, etc . . . ).

The invention may naturally be applied to other types of projectiles (even non-supersonic ones) that are fin-stabilized, e.g., mortar projectiles, grenades, rockets, missiles.

It is also applicable to sub-munitions having a stabilizing tail piece that is scatterable by means of a cargo vector (artillery shell or rocket).

We claim:

1. A tail piece for a projectile, comprising:

at least three fins coupled to the projectile, each fin including at least one recess having a side delimited by a corresponding external fin support surface of the projectile, wherein the at least one recess extends radially to a height selected to reduce Magnus strain, said Magnus strain being generated by an aerodynamic flow appearing on a body of the projectile when the projectile is in its trajectory at a certain range of obliquity; and at least one fastening foot for coupling each of the at least three fins to the projectile.

2. A tail piece according to claim 1, wherein each fin is linked to the projectile by at least two fastening feet spaced by the at least one recess.

3. A tail piece according to claim 2, wherein the fins define a second recess extending beyond a central portion of the projectile and between trailing edges of each fin.

4. A tail piece according to claim 1, wherein the height of each recess is at least equal to a thickness of a boundary layer measured at the tail piece during firing and in operational conditions of maximum obliquity.

5. A tail piece according to claim 1, wherein the height of each recess is selected in a range between about 40% and about 80% of a thickness of a boundary layer measured at the tail piece during firing and in operational conditions of maximum obliquity.

6. A tail piece according to claim 1, wherein the projectile is a fin-stabilized projectile, and wherein a height of each recess is between about 10% and 50% of a half-caliber of the tail piece.

7. A tail piece according to claim 1, wherein the at least one fastening foot of each fin is accommodated in a corresponding cavity arranged on a bracket of the projectile, and wherein the at least one fastening foot is fastened to the bracket by linking means.

8. A tail piece according to claim 7, wherein the bracket is fastened to a rear part of the body of the projectile.

9. A tail piece according to claim 8, wherein the rear part of the body and the bracket include cooperable threads.

10. A tail piece according to claim 7, wherein the bracket for the fins is formed as a one-piece unit with the body of the projectile, the projectile including at least three cavities for receiving the at least one fastening foot of each of said at least three fins.

11. A tail piece according to claim 7, wherein the linking means comprises one of welding and bonding means.

12. The tail piece according to claim 1, wherein said range of obliquity is between about 2 to 3 degrees.

13. The tail piece according to claim 12, wherein said projectile rotates at a rate of greater than about 100–1300 revolutions per second.

14. The tail piece according to claim 1, wherein said projectile is a supersonic projectile.

15. The tail piece according to claim 1, wherein said projectile is a gun fired projectile that is fired through a barrel of a gun at supersonic speeds.

16. A tail piece for a projectile, said projectile travelling with a boundary layer formed on a surface of the projectile during flight, said tail piece comprising:

a plurality of fins coupled to the projectile;

at least one fastening foot for coupling the plurality of fins to the projectile; and fin stabilizing structure for substantially eliminating dissymmetries in the boundary layer formed on the projectile during flight, said fin stabilizing structure including a first recess formed in each of said plurality of fins, each said first recess having a side delimited by a surface of the projectile, wherein each said first recess extends radially to a height selected to reduce Magnus strain, said Magnus strain being generated by an aerodynamic flow appearing on a body of the projectile when the projectile is in its trajectory at a certain range of obliquity.

17. A tail piece according to claim 16, wherein each fin is linked to the projectile by at least two fastening feet.

18. A tail piece according to claim 16, wherein said stabilizing structure further comprises a second recess extending beyond a central portion of the projectile to a trailing edge of each fin.

19. A tail piece according to claim 16, wherein the height of each said first recess is at least equal to a thickness of the boundary layer.

20. A projectile comprising:

a body subjectable to formation of a boundary layer during flight; and a tail piece connectable to said body, said tail piece including a plurality of fins coupled to the projectile, and fin stabilizing structure for substantially eliminating dissymmetries in the boundary layer formed on the projectile during flight, wherein said fin stabilizing structure includes a recess formed in each of said plurality of fins, each said recess being formed between a surface of the body and an edge of a fin opposite the surface, each said recess following the general contour of each said fin, wherein each said recess extends radially to a height selected to reduce Magnus strain, said Magnus strain being generated by an aerodynamic flow appearing on the body of the projectile when the projectile is in its trajectory at a certain range of obliquity.

21. A projectile according to claim 20, wherein a height of each recess is at least equal to a thickness of the boundary layer.

22. A projectile according to claim 20, wherein the stabilizing structure includes a second recess extending beyond a central portion of the projectile to a trailing edge of each fin.

* * * * *